United States Patent [19]

Lampert

[11] 4,177,616

[45] Dec. 11, 1979

[54] INSULATED FURNACE STRUCTURE

[76] Inventor: Albert J. Lampert, 605 Avenue Teresa, San Clemente, Calif. 92676

[21] Appl. No.: 833,176

[22] Filed: Sep. 14, 1977

Related U.S. Application Data

[63] Continuation-in-part of Ser. No. 777,059, Mar. 14, 1977, Pat. No. 4,083,155.

[51] Int. Cl.[2] ..... E04B 1/80

[52] U.S. Cl. ..... 52/509; 52/91; 52/506; 52/513; 52/585; 52/593

[58] Field of Search ..... 52/404, 265, 267, 91, 52/506, 509, 513, 585, 593, 408, 410, 405

[56] References Cited

U.S. PATENT DOCUMENTS

| | | | |
|---|---|---|---|
| 1,463,045 | 7/1923 | Liptak | 52/405 X |
| 2,120,133 | 6/1938 | Kohler | 52/506 X |
| 2,141,397 | 12/1938 | Locke | 52/513 X |
| 2,144,598 | 1/1939 | Brinkerhoff et al. | 110/336 |
| 2,147,946 | 2/1939 | Jaros | 110/336 |
| 2,858,582 | 11/1958 | Toulmin, Jr. | 52/585 X |
| 3,378,975 | 4/1968 | Hill | 52/404 |
| 3,892,396 | 7/1975 | Monaghan | 52/506 X |
| 3,940,244 | 2/1976 | Sander et al. | 110/336 |
| 3,952,470 | 4/1976 | Byrd, Jr. | 52/509 |
| 4,001,996 | 1/1977 | Byrd, Jr. | 52/509 |

FOREIGN PATENT DOCUMENTS

| | | | |
|---|---|---|---|
| 607315 | 3/1926 | France | 52/509 |
| 581758 | 10/1946 | United Kingdom | 52/513 |

*Primary Examiner*—Alfred C. Perham

*Attorney, Agent, or Firm*—Fulwider, Patton, Rieber, Lee & Utecht

[57] ABSTRACT

A thermal enclosure for use as a furnace having non-structural pads of pliant, low density material made of randomly interwoven ceramic fibers that form a continuous insulating layer overlying its interior surface. The pads can be interlocked along their edges and are held in place by hangers secured to the walls. Each hanger includes a pin driven into the wall, a plurality of vertical rods that extend into the pads and a cross piece that ties the rods to the pin. Since the hangers do not extend all the way through the pads, they are insulated from the interior furnace temperatures.

8 Claims, 8 Drawing Figures

INSULATED FURNACE STRUCTURE

BACKGROUND OF THE INVENTION

This is a continuation-in-part of applicant's copending application Ser. No. 777,059, entitled Thermally Insulated Enclosure, and filed on Mar. 14, 1977 now U.S. Pat. No. 4,083,155.

The present invention relates to the construction and modification of furnaces and to insulating pads useful for such purposes.

Conventional furnace construction usually employs walls of heavy, rigid, refractory bricks to provide thermal insulation. Although the bricks are self-supporting, they are usually secured to steel walls or a steel frame work for added strength. To provide additional insulation, especially in the case of older furnaces in which there may be voids in the walls where the bricks are broken away, it is a common practice to add insulating blankets of fibrous material, such as ceramic wool, over the interior surfaces of the walls. In some instances, small sections or blocks of blanket-like insulating material are individually secured to the walls.

To attach an insulating layer to the refractory brick walls of a furnace by known methods is a time consuming and expensive process. It is necessary to drive pins into the brick, the typical distance between pins being about fourteen inches. Since the pins are exposed to the high temperatures of the furnace interior, they must be made of costly Inconel or stainless steel. Some efforts to reduce the cost of providing supplemental insulation involve gluing the blankets to the furnace walls, but this inventor has found that glued blankets tend to loosen in about three to six months.

SUMMARY OF THE INVENTION

The present invention provides effective durable insulation for the inner wall surfaces of furnaces and other thermal enclosures at greatly reduced cost. It employs nonstructural, generally rectangular pads to form a continuous insulating layer over the interior surfaces of the refractory brick furnace walls. Each pad is formed by a single uninterrupted mass of pliant, low density material made of randomly interwoven ceramic fibers. Preferably, each pad has two parallel, V-shaped, interlocking ends, one end having an indented centerline while the other has a protruding centerline. While these pads are well suited for use as added insulation by way of modifying existing furnaces, they can also be used as part of the original furnace construction, with or without refractory brick walls.

Hangers project inwardly from the walls to maintain the pads in the desired positions contiguous to the original wall surface. In a particularly advantageous arrangement, the hangers engage a plurality of rods, each rod extending into at least two adjacent pads. A plurality of pins project from the walls and cross pieces connect the pins to the rods. The pins should extend from the walls a distance substantially less than the thickness of the pads so that the pins are insulated from the high interior furnace temperatures. It is, therefore, possible to use pins made of relatively inexpensive common steel.

Preferably, two rods extend through bores in each pad. The rods are oriented vertically, parallel to the interlocking pad ends, and each cross piece engages two rods that pass through two different pads. This hanger structure permits the use of substantially fewer pins than would otherwise be required.

Other features and advantages of the present invention will become apparent from the following detailed description, taken in conjunction with the accompanying drawings which illustrate, by way of example, the principles of the invention.

DESCRIPTION OF THE PREFERRED EMBODIMENT

Figures 1, 2, 3, 4, 5, 6, 7, 8:
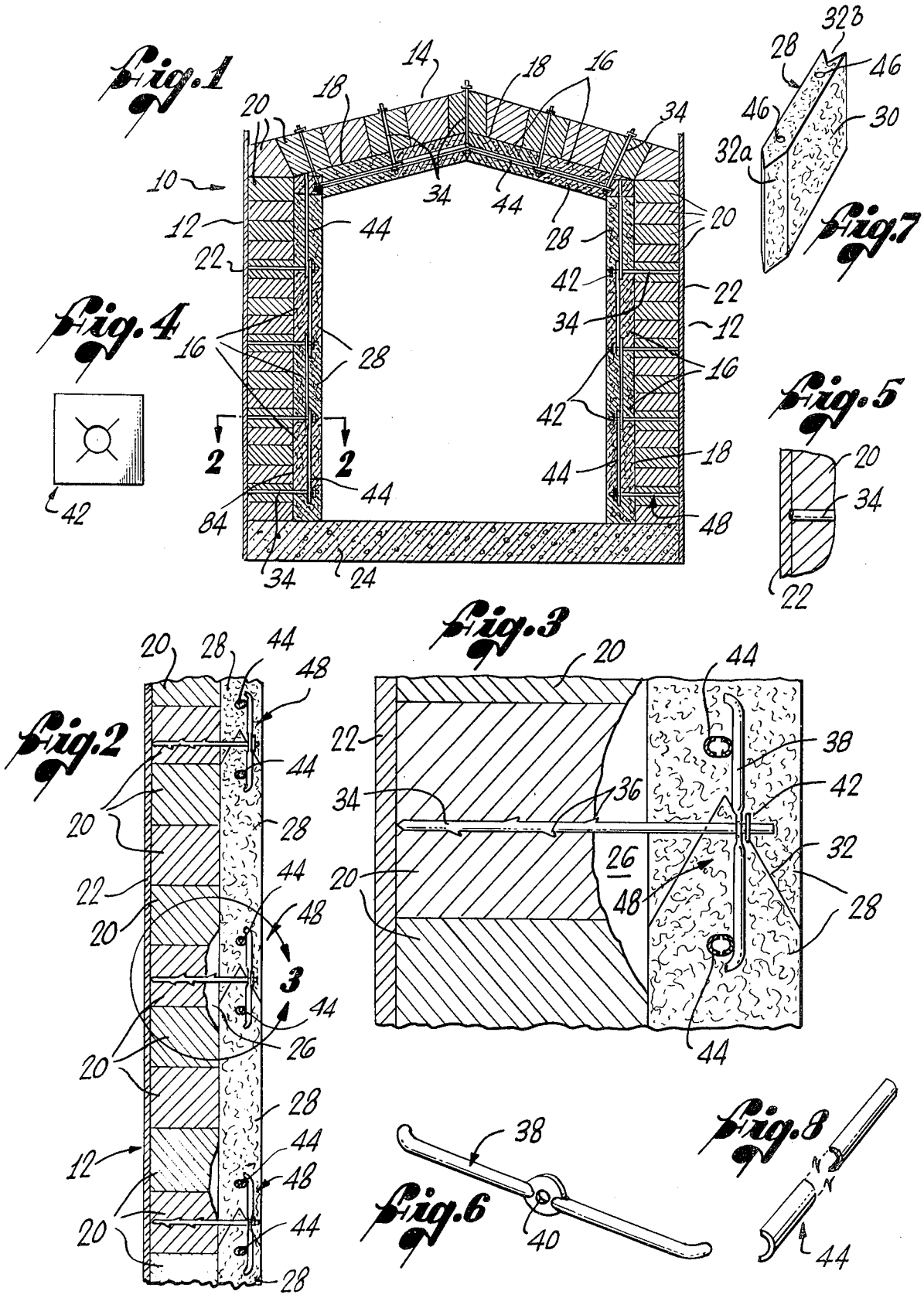
FIG. 1 is a cross-sectional view of an exemplary furnace that has been modified by the addition of insulating pads covering interior wall surfaces.
FIG. 2 is an enlarged, cross-sectional, fragmentary view of a wall of the furnace taken along the line 2—2 of FIG. 1.
FIG. 3 is a further enlarged, cross-sectional, fragmentary view of the wall, taken substantially as indicated by the arrow 3 in FIG. 2.
FIG. 4 is an enlarged elevation of a fastener used in the hanger that attaches the pads to the walls.
FIG. 5 is a fragmentary, cross-sectional view showing an alternative arrangement for attaching the hangers to the walls.
FIG. 6 is an enlarged, perspective view of a cross piece that forms part of a hanger.
FIG. 7 is a perspective view of an insulating pad used in the furnace.
FIG. 8 is an enlarged, perspective view, partially broken away, of a rod that forms part of a hanger.

An exemplary furnace 10, the construction of which has been modified in accordance with the present invention, is illustrated in FIGS. 1-8 in the accompanying drawings. In general, the modified furnace 10 includes walls 12 and an arched roof 14 with insulating pads 16 attached by hangers 18 to the interior surfaces.

The original pre-existing furnace is a conventional structure, the walls 12 and roof 14 being formed of heavy, rigid, refractory bricks 20, as shown in FIGS. 1, 2 and 3. Steel plates 22 reinforce the exterior surfaces of the walls 12 and a concrete slab 24 forms the floor. As is common in older furnaces of this type, excessive heat loss occurs through the original walls and roof, partially due to the formation of voids 26 where the bricks 20 are broken away.

A modification of the original furnace 10 in, accordance with the present invention, provides supplemental insulation consisting of generally rectangular, nonstructural pads 28 that overlie the interior wall and roof surfaces to form a continuous insulating layer. Each relatively low density pad 28 consists of soft, pliant, resilient, ceramic fibers that form a single undivided and uninterrupted mass. In this embodiment, the ceramic material is a naturally occurring alumina-silica fire clay called kaolin formed into fibers 4 to 10 inches long that are randomly interwoven to form a ceramic wool. Suitable material of this nature is presently sold by the Babcock & Wilcox Company under the trademark KAOWOOL. It has a melting point of approximately 3200° F.

Each discrete pad 28 has flat sides 30 in the plane of the adjacent wall 12 or roof 14, as shown in FIG. 7. By way of example, pads 28 that are about 36 inches square have been found highly satisfactory. For temperatures of 1600°-1800° F., the pads 28 should be about four inches thick.

To minimize any heat loss along the joints between horizontally adjacent pads 28, each pad has two parallel, vertical oriented, V-shaped ends 32. One end 32*a* has a protruding centerline while the other end 32*b* has a recessed centerline so that adjacent pads 28 can be mutually interlocked with a minimum of manipulation and adjustment. The pads 28 that form corners (not shown) are an exception, being square-cut at one end and insulating strips can be laid internally along the corners to compensate for the fact that those joints are not interlocking. Interlocking of horizontal joints is usually unnecessary since the weight of the pads 28 themselves is sufficient to avoid the formation of gaps.

In addition to their suitability for the modification of existing conventional furnaces, as described herein, the pads 28 can be used in the original furnace construction. Accordingly, the pads 28 themselves form one aspect of the present invention. An exemplary furnace employing such pads as part of its original structure is described in my above-mentioned copending application Ser. No. 777,059.

To hold the pads 28 in position, pins 34 extend horizontally from the walls 12 and downwardly from the roof 14. Each pin 34 is driven into the brick 20 where it is retained by small rearwardly projecting spurs 36 (FIG. 3). Alternatively, the pin 34 can be abutted against the steel plates 22 and flash welded in position, as shown in FIG. 5.

At its inner end, inserted between two vertically adjacent but discrete pads 28, each pin 34 carries a horizontal cross piece 38 with the pin projecting through a hole 40 in the center of the cross piece (FIG. 6). An apertured spring clip 42 (FIG. 4) prevents the cross piece 38 from sliding off the end of the pin 34. Each cross piece 38 engages retaining rods 44 that extend through vertical bores 46 in the pads 28 (FIG. 7), the rods being arcuate in cross-section for rigidity and ease of manufacturing. At each point where four pads 28 intersect, there are two rods 44 that project downwardly from the upper pads and two rods that project upwardly from the lower pads, an upwardly projecting rod and a downwardly projecting rod sharing the end of a single bore. A cross piece 38 engages two rods 44 on either side of the pin 34. The pads 28 are in this way locked together in an integrated arrangement of increased strength. The rods 44 and cross piece 38 are located half way between the opposing flat sides 30 of the pads 28.

Utilizing hangers 48 thus formed by the pins 34, rods 44 and cross pieces 38, it is possible to space the pins at a distance considerably greater than the maximum that is satisfactory when conventional blanket hanging techniques are used. Typically, the pins 34 are spaced apart about 36 inches both vertically and horizontally.

It should be noted that the pins 34 extend from the walls 12 and roof 14 a distance substantially less than the thickness of the pads 28 so that the remaining pad thickness insulates the pins from the interior furnace temperature. It is, therefore, possible to use pins 34 made of ordinary steel rather than the much more expensive Inconel or stainless steel pins that have been used in the past to secure insulating blankets in similar environments. With a furnace temperature of 1800° F., for example, a pin 34 recessed two inches from the interior surface of the pads 28 will not exceed about 335° F. Moreover, the insulation of the entire metal structure of the hangers minimizes heat loss by thermal conduction.

It will be apparent that the present invention provides for highly effective furnace insulation at greatly reduced cost. While a particular form of the invention has been illustrated and described, it will be apparent that various modifications can be made without departing from the spirit and scope of the invention.

I claim:

1. A thermal enclosure for use as a furnace comprising:

a plurality of structural walls of refractory brick;

a plurality of discrete, non-structural, soft, pliant pads arranged adjacent to each other according to a predetermined pattern to form a continuous insulating layer over the interior surface of said walls, each of said pads being formed throughout by a pliant, low density material made of a single, undivided and uninterrupted mass of randomly interwoven ceramic fibers, and each of said pads having mutually interlocking V-shaped ends; and hanger means projecting inwardly from said walls for maintaining said pads in an overlying relationship with respect to said walls.

2. A thermal enclosure for use as a furnace comprising:

a plurality of structural walls of refractory brick;

a plurality of discrete, non-structural, generally rectangular pads arranged to form a continuous insulating layer over the interior surface of said walls, each of said pads being formed of a pliant, low density material made of a single undivided mass of randomly interwoven ceramic fibers, and having mutually interlocking ends; and hanger means projecting inwardly from said walls for maintaining said pads in an overlying relationship with respect to said walls, said hanger means comprising a plurality of rods each extending into at least two adjacent pads, a plurality of pins attached to said walls, and a plurality of cross pieces connecting said pins to said rods.

3. The thermal enclosure of claim 2 wherein said pins extend from said walls a distance substantially less than the thickness of said pads, whereby said pads insulate said pins from the interior of said furnace.

4. A thermal enclosure for use as a furnace comprising:

a plurality of structural walls of refractory brick;

a plurality of discrete, non-structural, generally rectangular pads arranged to form a continuous insulating layer over the interior surface of said walls, each of said pads being formed of a pliant, low density material made of a single undivided mass of randomly interwoven ceramic fibers, and having mutually interlocking V-shaped ends; and hanger means projecting inwardly from said walls for maintaining said pads in an overlying relationship with respect to said walls.

5. A thermal enclosure for use as a furnace comprising:

a plurality of structural walls of refractory brick;

a plurality of discrete non-structural, generally rectangular pads arranged to form a continuous insulating layer over the interior surface of said walls, said pads being formed of a pliant, low density material made of ceramic fibers and having at least two bores extending vertically therethrough, said pads having two opposite, V-shaped, vertical ends, one of said ends being indented at its center and the other of said ends protruding at its center, the ends of horizontally adjacent pads being interlocked;

a vertical retaining rod extending through each of said bores, the ends of each such rod extending into the vertically adjacent pads;

a plurality of pins anchored in said walls, each of said pins extending from said wall a distance substantially less than the thickness of said pads, thereby insulating said pins from the interior of said furnace; and a plurality of cross pieces each of which is perpendicularly connected to one of said pins and extends parallel to one of said walls and engages two rods that extend through two different pads, whereby said pads are maintained in a contiguous, overlying relationship with respect to said walls.

6. The thermal enclosure of claim 5 wherein the ceramic fibers of each of said pads are randomly interwoven to form a single undivided mass.

7. A thermal enclosure for use as a furnace comprising:

a plurality of wall means for providing structural support;

a plurality of discrete, non-structural, soft, pliant pads arranged adjacent to each other according to a predetermined pattern to form a continuous insulating layer over said wall means, each of said pads being formed throughout by a pliant, low density material made of a single, undivided and uninterrupted mass of randomly interwoven ceramic fibers, each of said pads having mutually interlocking V-shaped ends; and hanger means projecting from said wall means for maintaining said pads in an interlocking relationship.

8. A thermal enclosure for use as a furnace comprising:

a plurality of wall means for providing structural support;

a plurality of discrete, non-structural, generally rectangular pads arranged to form a continuous insulating layer over said wall means, each of said pads being formed of a pliant, low density material made of a single, undivided mass of randomly interwoven ceramic fibers, and having mutually interlocking, V-shaped ends; and hanger means projecting from said wall means for maintaining said pads in an interlocking relationship.

* * * * *